US012221319B2

(12) United States Patent
Ho et al.

(10) Patent No.: US 12,221,319 B2
(45) Date of Patent: Feb. 11, 2025

(54) AUTOMATIC SHEET FEEDING DEVICE HAVING FLIPPING MECHANISM

(71) Applicant: KINPO ELECTRONICS, INC., New Taipei (TW)

(72) Inventors: Pei-Chi Ho, New Taipei (TW); Po-Chih Chang, New Taipei (TW)

(73) Assignee: KINPO ELECTRONICS, INC., New Taipei (TW)

( * ) Notice: Subject to any disclaimer, the term of this patent is extended or adjusted under 35 U.S.C. 154(b) by 175 days.

(21) Appl. No.: 17/993,847

(22) Filed: Nov. 23, 2022

(65) Prior Publication Data

US 2024/0109739 A1 Apr. 4, 2024

(30) Foreign Application Priority Data

Sep. 30, 2022 (CN) ..... 202211215128.0

(51) Int. Cl.

| | |
|---|---|
| ***B65H 85/00*** | (2006.01) |
| ***B65H 5/06*** | (2006.01) |
| ***B65H 5/26*** | (2006.01) |
| ***B65H 5/36*** | (2006.01) |
| ***B65H 15/00*** | (2006.01) |

(Continued)

(52) U.S. Cl.

CPC ..... *B65H 85/00* (2013.01); *B65H 5/062* (2013.01); *B65H 5/26* (2013.01); *B65H 5/36* (2013.01); *B65H 15/004* (2020.08); *B65H 29/22* (2013.01); *B65H 29/58* (2013.01); *B65H 2301/333* (2013.01); *B65H 2301/4212* (2013.01); *B65H 2404/632* (2013.01)

(58) Field of Classification Search

CPC ..... B65H 5/02; B65H 5/021; B65H 15/004; B65H 15/008; B65H 29/12; B65H 29/125; B65H 29/20; B65H 29/58; B65H 29/60; B65H 85/00; B65H 2301/333; B65H 2404/63; B65H 2404/632; B65H 2404/633

See application file for complete search history.

(56) References Cited

U.S. PATENT DOCUMENTS 5,392,109 A * 2/1995 Acquaviva ..... H04N 1/00612 399/209
6,115,578 A * 9/2000 Mandel ..... H04N 1/00631 399/374

(Continued)

*Primary Examiner* — Prasad V Gokhale

(74) *Attorney, Agent, or Firm* — Chun-Ming Shih; HDLS IPR SERVICES

(57) ABSTRACT

This disclosure is directed to an automatic sheet feeding device having a flipping mechanism which is used for a sheet. The automatic sheet feeding device has a sheet outputting tray, a sheet outputting channel, the flipping mechanism and a switching guide mechanism. The sheet outputting channel is disposed corresponding to the sheet outputting tray. The flipping mechanism is arranged between the sheet outputting channel and the sheet outputting tray. The switching guide mechanism is arranged between the sheet outputting channel and the flipping mechanism, and the switching guide mechanism is used for guiding the sheet to be conveyed to the sheet outputting tray from the sheet outputting channel or conveyed to the sheet outputting tray from the flipping mechanism. Therefore, an efficiency of duplex scanning of the automatic sheet feeding device may be improved.

7 Claims, 7 Drawing Sheets

(51) Int. Cl.
*B65H 29/22* (2006.01)
*B65H 29/58* (2006.01)

(56) References Cited

U.S. PATENT DOCUMENTS

| | | | | |
|---|---|---|---|---|
| 7,481,427 | B2 * | 1/2009 | Tokutsu | B65H 5/00 271/291 |
| 2018/0272756 | A1 * | 9/2018 | Kodama | B41J 3/60 |

* cited by examiner

AUTOMATIC SHEET FEEDING DEVICE HAVING FLIPPING MECHANISM

BACKGROUND OF THE DISCLOSURE

Technical Field

This disclosure is directed to an automatic sheet feeding device, and in particular to an automatic sheet feeding device having a flipping mechanism.

Description of Related Art

A related automatic sheet feeding device (Auto Document Feeder, ADF) having scanning function are usually used in an office. A sheet is fed from a sheet feeding tray into the device, then to a working area for scanning a front side thereof, and output to a sheet outputting tray finally, so as to complete a single-side scanning to the sheet.

Moreover, when the automatic sheet feeding device scanning dual sides of the sheet, the sheet is conveyed into the device again and overturned after the single-side scanning, and then the sheet is conveyed to a working area for scanning a back side thereof.

However, the sheet is placed with the front side facing up after scanning the back side of the sheet. Therefore, the sheet should be conveyed the third time into the device for overturning again to flip the sheet to a predetermined condition with the front side facing down. Accordingly, the sheet should be conveyed into and out from the device for three times, and the duplex scanning is therefore time consuming.

In view of the above drawbacks, the inventor proposes this disclosure based on his expert knowledge and elaborate researches in order to solve the problems of related art.

SUMMARY OF THE DISCLOSURE

This disclosure is directed to an automatic sheet feeding device having a flipping mechanism, which a sheet may be overturned by the flipping mechanism and then fed into a sheet outputting tray, so that the step of entering the device for flipping may be omitted and the time may be saved, so as to improve an efficiency of duplex scanning of the automatic sheet feeding device.

In an embodiment, this disclosure is directed to an automatic sheet feeding device which is used for a sheet. The automatic sheet feeding device has: a sheet outputting tray; a sheet outputting channel, disposed corresponding to the sheet outputting tray; a flipping mechanism, arranged between the sheet outputting channel and the sheet outputting tray; and a switching guide mechanism, arranged between the sheet outputting channel and the flipping mechanism, and the switching guide mechanism is used for guiding the sheet to be fed to the sheet outputting tray from the sheet outputting channel or fed to the sheet outputting tray from the flipping mechanism.

Accordingly, the automatic sheet feeding device according to this disclosure conveys the sheet to the flipping mechanism for flipping via the switching guide mechanism and further conveys to the sheet outputting tray, after scanning both sides of the sheet entered into the device again. Therefore, a function of putting the sheet being dual-side scanned in the sheet outputting tray with a front side facing down is achieved. Furthermore, comparing with the related arts, the operation of entering the device is reduced by one step and the time is saved, so that the automatic sheet feeding device according to the present disclosure has advantages of conveying the sheet rapidly, saving time of duplex scanning, and improving an efficiency of duplex scanning.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

Figure 1:
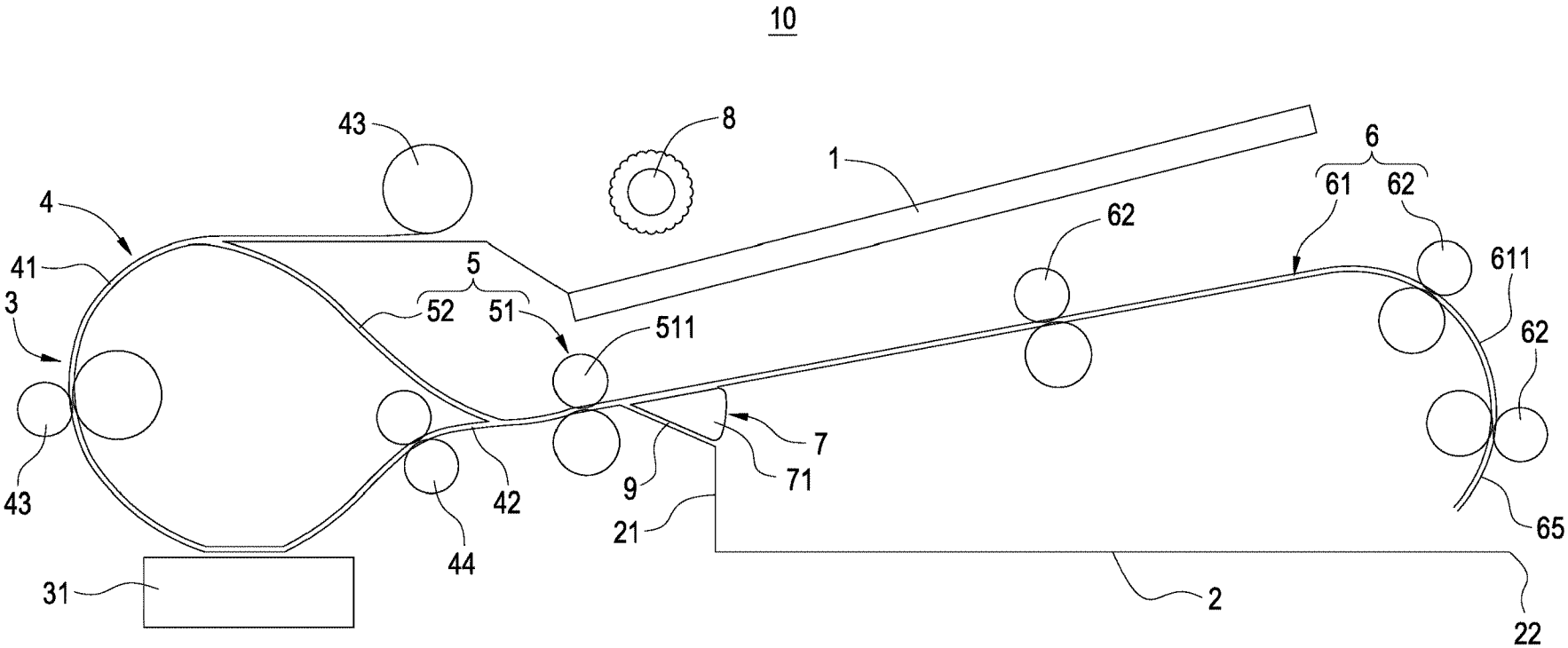
FIG. 1 is a perspective view showing an automatic sheet feeding device according to this disclosure.

The technical contents of this disclosure will become apparent with the detailed description of embodiments accompanied with the illustration of related drawings as follows. It is intended that the embodiments and drawings disclosed herein are to be considered illustrative rather than restrictive.

According to FIGS. 1 to 5, this disclosure is directed to an automatic sheet feeding device having a flipping mechanism used for a sheet (not shown in figures). The automatic sheet feeding device (or Auto Document Feeder, ADF) 10 mainly has a sheet outputting tray 2, a sheet outputting channel 9, a flipping mechanism 6 and a switching guide mechanism 7.

According to FIGS. 1 to 5, the automatic sheet feeding device 10 according to this disclosure further has a sheet feeding tray 1 and a sheet delivery area 3, the sheet delivery area 3 is disposed between the sheet feeding tray 1 and the sheet outputting tray 2, and the sheet delivery area 3 has a scanning module 31, the sheet feeding tray 1 may be an external manual tray arranged at an outside of the automatic sheet feeding device 10 or an inner cassette arranged in the automatic sheet feeding device 10, the scanning module 31 is used for scanning the sheet, the sheet outputting tray 2 has a first side 21 and a second side 22 opposite to each other.

According to FIGS. 1 to 5, the sheet outputting channel 9 is disposed corresponding to the sheet outputting tray 2 and disposed between the sheet delivery area 3 and the sheet outputting tray 2. The detail descriptions are described below, the sheet outputting channel 9 is adjacent to the first side 21 of the sheet outputting tray 2, and a terminal end of the sheet outputting channel 9 adjacent to the sheet outputting tray 2 is extended along a direction from the first side 21 toward the second side 22, so as to feed the sheet by the sheet outputting channel 9 in the direction from the first side 21 toward the second side 22.

According to FIGS. 1 to 5, the automatic sheet feeding device 10 according to this disclosure further has a first feeding mechanism 4 disposed in the sheet delivery area 3, the first feeding mechanism 4 has a flipping channel 41 and a delivery channel 42. The flipping channel 41 is disposed between the sheet feeding tray 1 and the scanning module 31. The delivery channel 42 is arranged corresponding to the flipping mechanism 6 and passing through the scanning module 31. One end of the delivery channel 42 communicates with the flipping channel 41 and another end of the delivery channel 42 communicates with the sheet outputting channel 9. The flipping channel 41 is a curved route, so that the sheet passing through the flipping channel 41 is overturned and further fed into the delivery channel 42, the sheet in the delivery channel 42 is scanned by the scanning module 31 and further fed into the sheet outputting channel 9 or the flipping mechanism 6.

Moreover, the first feeding mechanism 4 further has one or multiple first delivery rollers 43 located on the flipping channel 41 and one or multiple second delivery rollers 44 located on the delivery channel 42, the first delivery roller 43 and the second delivery roller 44 are used for conveying the sheet.

According to this disclosure shown in FIGS. 1 to 5, the automatic sheet feeding device 10 further has a second feeding mechanism 5 disposed in the sheet delivery area 3, the second feeding mechanism 5 has a reversing component 51 disposed corresponding to the delivery channel 42 and a retrieving channel 52 communicating with the flipping channel 41 and the delivery channel 42 respectively. The reversing component 51 may be a reversing roller 511 located on the delivery channel 42. The reversing roller 511 is used for conveying the sheet into the retrieving channel 52 from the delivery channel 42, so that the sheet is conveyed through the flipping channel 41 again and being overturned.

According to FIGS. 1 to 5, the flipping mechanism 6 is disposed between the sheet outputting channel 9 and the sheet outputting tray 2, the flipping mechanism 6 has a sheet conveying portion 65, the sheet conveying portion 65 is adjacent to the second side 22 of the sheet outputting tray 2 for conveying the sheet along a direction from the second side 22 toward the first side 21.

Further explanation is described below, the flipping mechanism 6 further has a reversing channel 61 and one or multiple conveying rollers 62 located on the reversing channel 61. The reversing channel 61 has one end communicating with the delivery channel 42 and another end having a curved guiding channel 611. The sheet conveying portion 65 is formed on a terminal end of the curved guiding channel 611 and extended along the direction from the second side 22 toward the first side 21. Therefore, the sheet is conveyed through the curved guiding channel 611 to be overturned and then conveyed to the sheet outputting tray 2 along the direction from the second side 22 toward the first side 21. The conveying roller 62 is used for conveying the sheet.

According to FIGS. 1 to 5, the switching guide mechanism 7 is disposed between the sheet outputting channel 9 and the flipping mechanism 6, the switching guide mechanism 7 may be a swing block 71 driven by an actuator (not shown in figures) to automatically swing. The swing block 71 may close the sheet outputting channel 9 or the reversing channel 61, so that the switching guide mechanism 7 may guide the sheet to be conveyed to the sheet outputting tray 2 from the sheet outputting channel 9 or to the sheet outputting tray 2 from the flipping mechanism 6.

According to this disclosure shown in FIGS. 1 to 5, the automatic sheet feeding device 10 further has a picking roller 8, the picking roller 8 is disposed on an end of the sheet feeding tray 1 adjacent to the first feeding mechanism 4, the picking roller 8 is used for conveying the sheet from the sheet feeding tray 1 into the flipping channel 41 of the first feeding mechanism 4.

Figure 2:
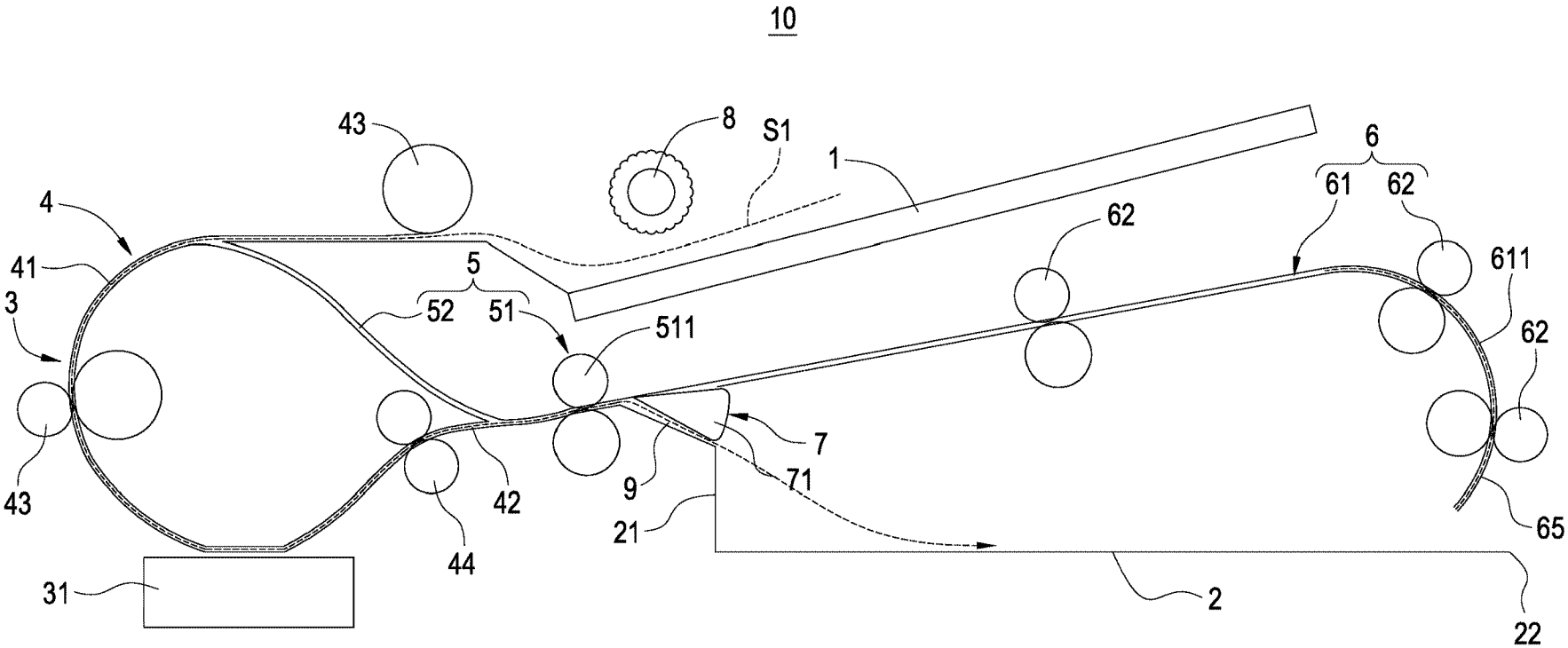
FIG. 2 is a schematic view showing one operation status of the automatic sheet feeding device according to this disclosure.

According to an operation status of this disclosure shown in FIGS. 2 to 5, firstly, when a specific side of the sheet needs to be scanned, the swing block 71 close the reversing channel 61 as shown in FIG. 2, so that the sheet is conveyed along a first moving route S1, which sequentially passes through the sheet feeding tray 1 (the external manual tray or the inner tray), the flipping channel 41, the scanning module 31, the delivery channel 42, the sheet outputting channel 9 to the sheet outputting tray 2. The sheet is conveyed through the flipping channel 41 to turn a front side thereof to face down in order to be scanned by the scanning module 31, so as to complete the scanning of the specific side of the sheet. At the same time, the sheet in the sheet outputting tray 2 is being placed in a predetermined condition with the front side facing down.

Figure 3:
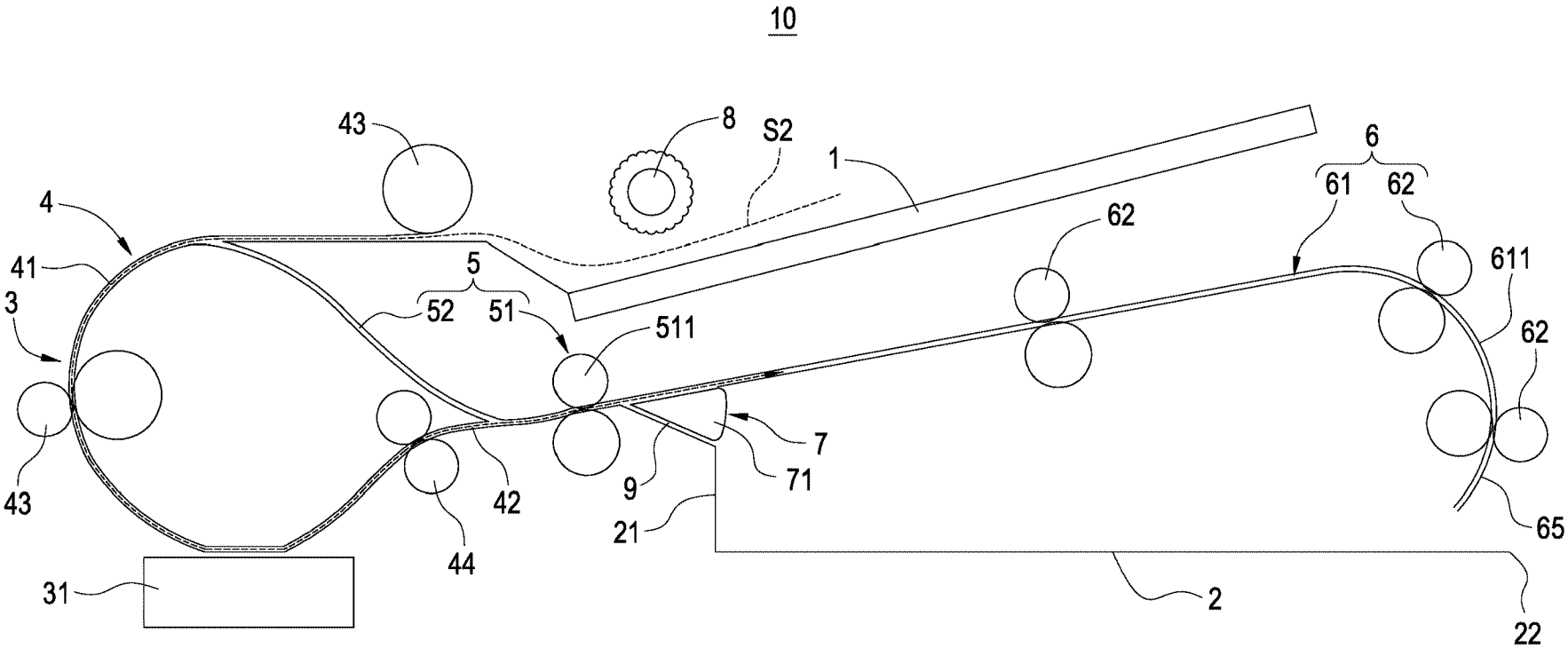
FIG. 3 is a schematic view showing another operation status of the automatic sheet feeding device according to this disclosure.
Figure 4:
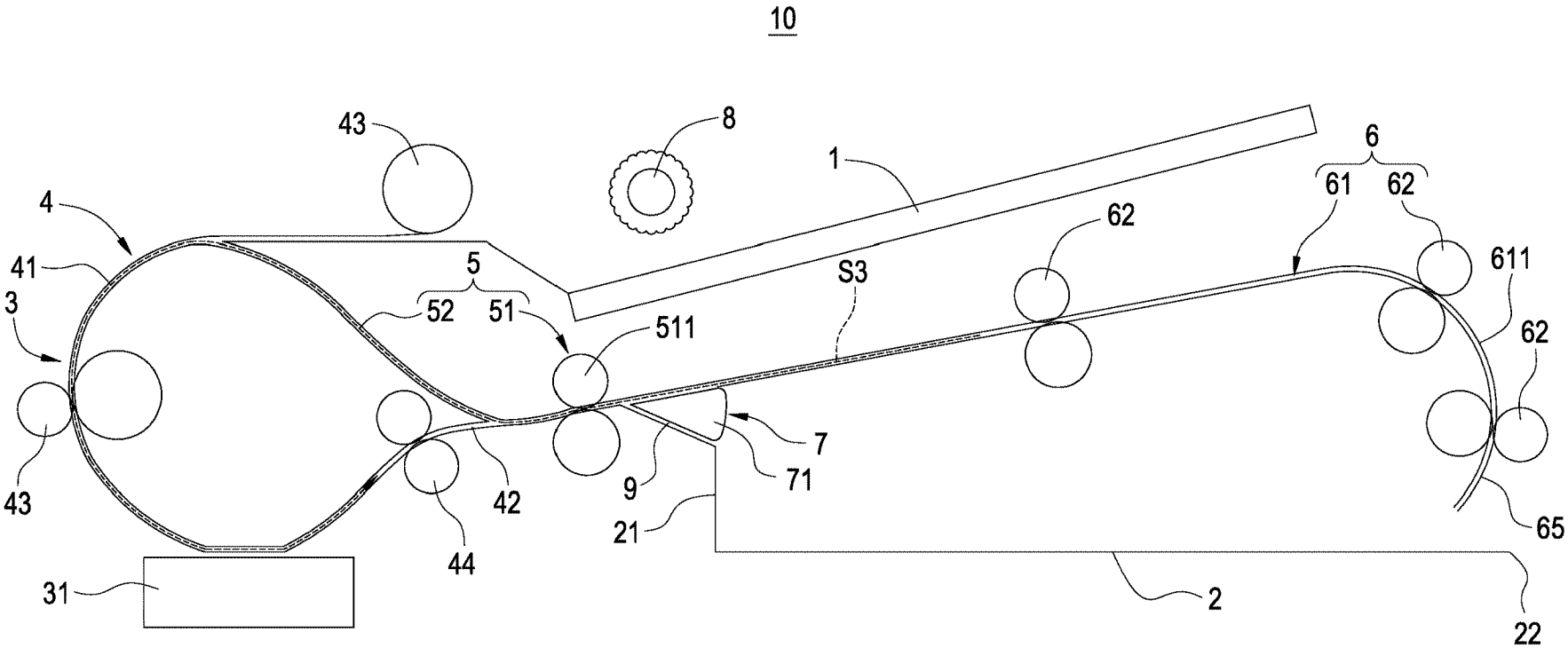
FIG. 4 is a schematic view showing further another operation status of the automatic sheet feeding device according to this disclosure.
Figure 5:
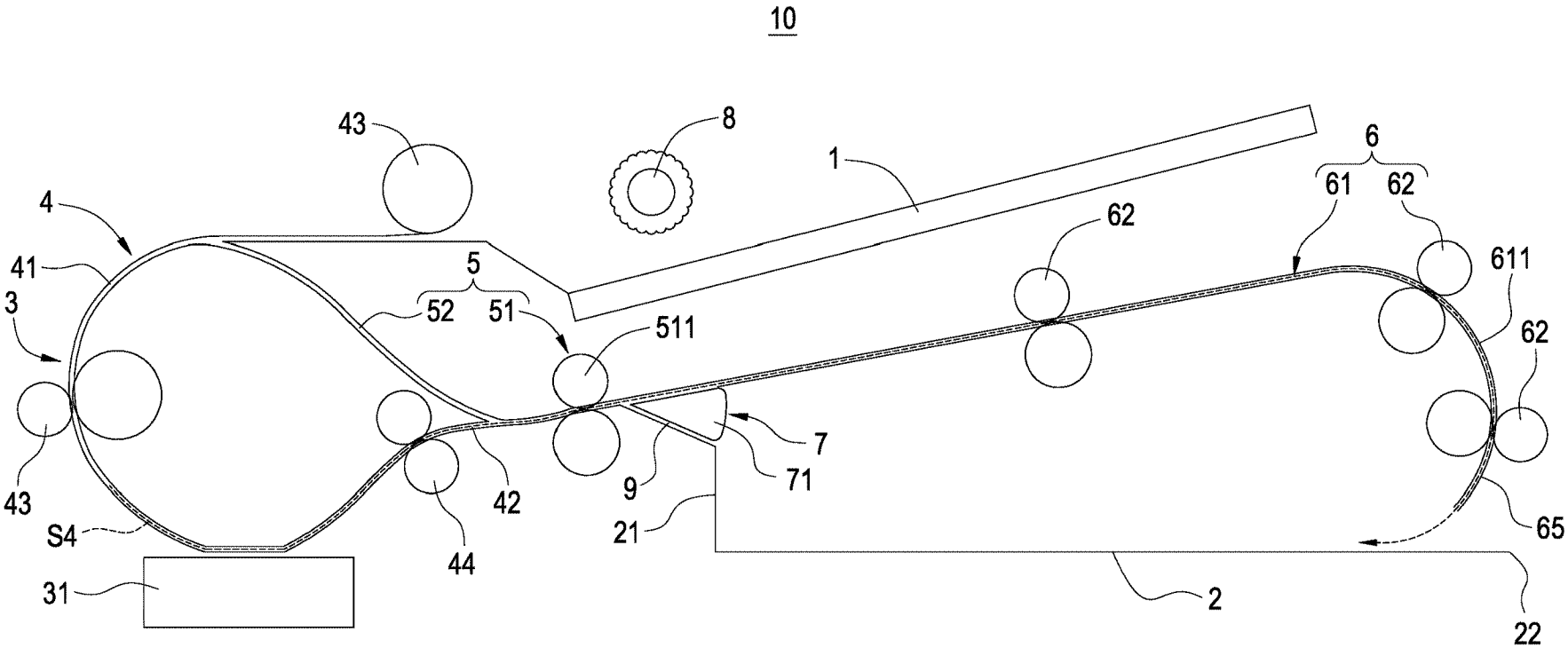
FIG. 5 is a schematic view showing still further another operation status of the automatic sheet feeding device according to this disclosure.

Moreover, when dual sides of the sheet need to be scanned, the swing block 71 closes the sheet outputting channel 9 as shown in FIG. 3 so that the sheet is conveyed along a second moving route S2, which sequentially passes through the sheet feeding tray 1 (the external manual tray or the inner tray), the flipping channel 41, the scanning module 31 to the delivery channel 42. The sheet is conveyed through the flipping channel 41 to turn the front side thereof to face down in order to be scanned by the scanning module 31. According to FIG. 4, the reversing roller 511 then reversely rotates to convey the sheet into the retrieving channel 52 from the delivery channel 42. The sheet is then conveyed along a third moving route S3, which sequentially passes through the delivery channel 42, the retrieving channel 52, the flipping channel 41, the scanning module 31 into the delivery channel 42. The sheet is conveyed through the flipping channel 41 to turn a back side thereof to face down in order to be scanned by the scanning module 31, so as to complete the scanning of the dual sides of the sheet. Finally, according to FIG. 5, the sheet is then conveyed along a fourth moving route S4, which sequentially passes through the delivery channel 42, the flipping mechanism 6 into the sheet outputting tray 2. The sheet is conveyed through the reversing channel 61 to turn the front side to face down and then conveyed into the sheet outputting tray 2 again, so that the sheet in the sheet outputting tray 2 is being placed in the predetermined condition with the front side facing down.

Accordingly, in a related-art automatic sheet feeding device, the sheet should be conveyed in and out from the machine body to be overturned for three times in order to place the sheet in the sheet outputting tray with the front side facing down after scanning dual sides of the sheet. Comparing to the related automatic sheet feeding device, according to the automatic sheet feeding device 10 of this disclosure, after the sheet is conveyed into the device again for a duplex scanning, the sheet is then conveyed to the flipping mechanism 6 by the switching guide mechanism 7 for overturning and further conveyed into the sheet outputting tray 2, so that the sheet being dual-side scanned is placed in the sheet outputting tray 2 in the predetermined condition. Furthermore, the steps of conveying the sheet into the device is reduced by one step and the time spent thereof may be saved, so that the automatic sheet feeding device 10 of this disclosure has the advantages of rapidly conveying the sheet, saving time of duplex scanning and improving an efficiency of duplex scanning.

Furthermore, the sheet outputting channel 9 is adjacent to the first side 21 of the sheet outputting tray 2, the flipping mechanism 6 is adjacent to the second side 22 of the sheet outputting tray 2, so that the terminal end of the sheet outputting channel 9 adjacent to the sheet outputting tray 2 is extended along the direction from the first side 21 toward the second side 22. Therefore, the sheet conveyed from the sheet outputting channel 9 to the sheet outputting tray 2 is transmitted along the direction from the first side 21 toward the second side 22. The reversing channel 61 has one end communicating with the delivery channel 42 and the other end having the curved guiding channel 611. The terminal end of the curved guiding channel 611 is extended along the direction from the second side 22 toward the first side 21. Therefore, the sheet conveyed from the flipping mechanism 6 to the sheet outputting tray 2 is transmitted along the direction from the second side 22 to the first side 21, so that the sheets being scanned for single-side or dual-side may be stacked up and down at the same position, and the documents may be arranged neatly.

Figure 6:
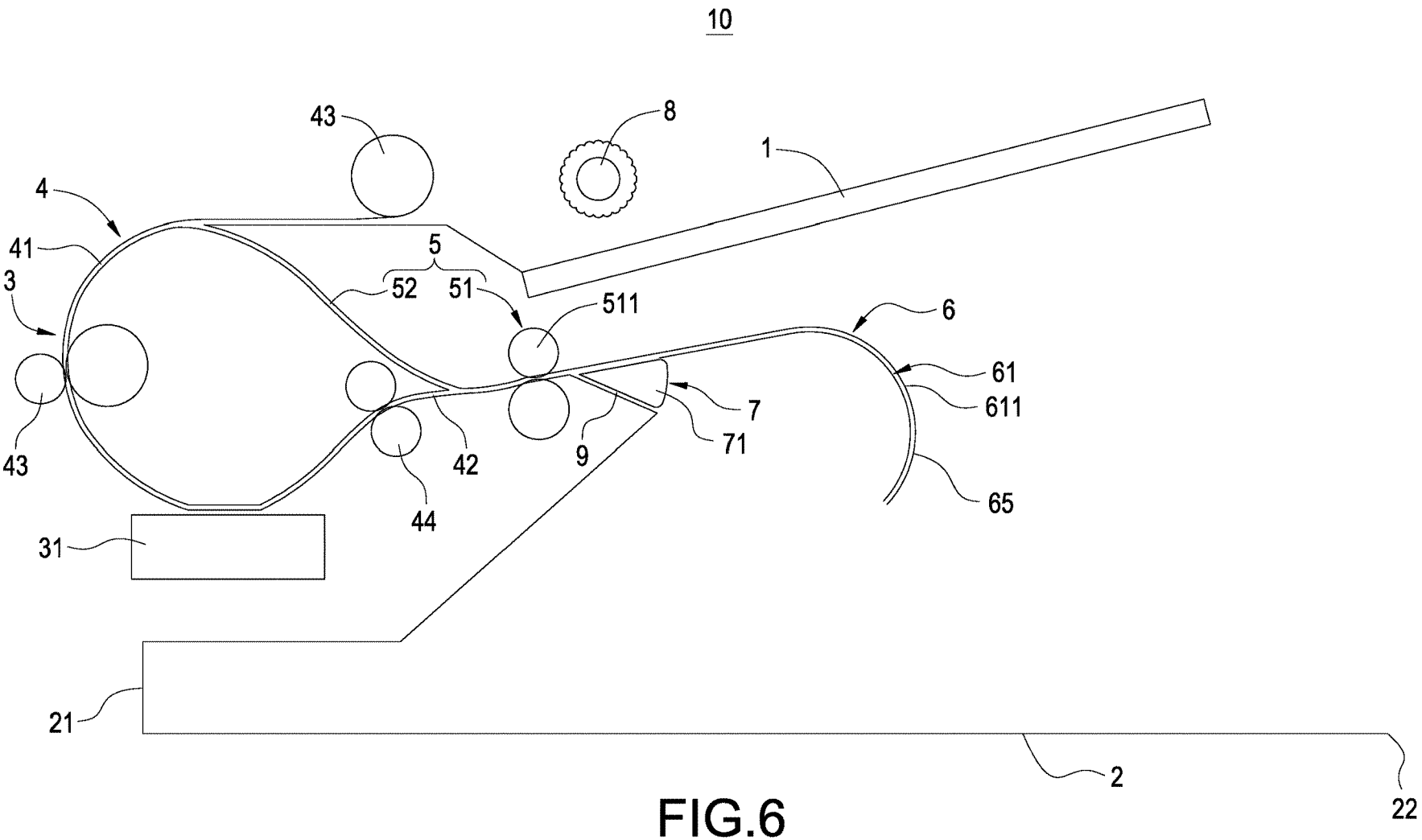
FIG. 6 is a perspective view showing an automatic sheet feeding device according to another embodiment of this disclosure.

Referring to FIG. 6 showing another embodiment according to the automatic sheet feeding device 10 of this disclosure, the embodiment shown in FIG. 6 is substantially the same as the embodiment shown in FIGS. 1 to 5, and the embodiment shown in FIG. 6 has a flipping mechanism 6 different from the embodiment shown in FIGS. 1 to 5.

The detail descriptions are described below, the conveying roller 62 of the flipping mechanism 6 as shown in FIGS. 1 to 5 is omitted in FIG. 6, because the conveying roller 62 is only used for rapidly conveying the sheet through the reversing channel 61, and the conveying roller 62 may be omitted depending on the specific requirement.

Figure 7:
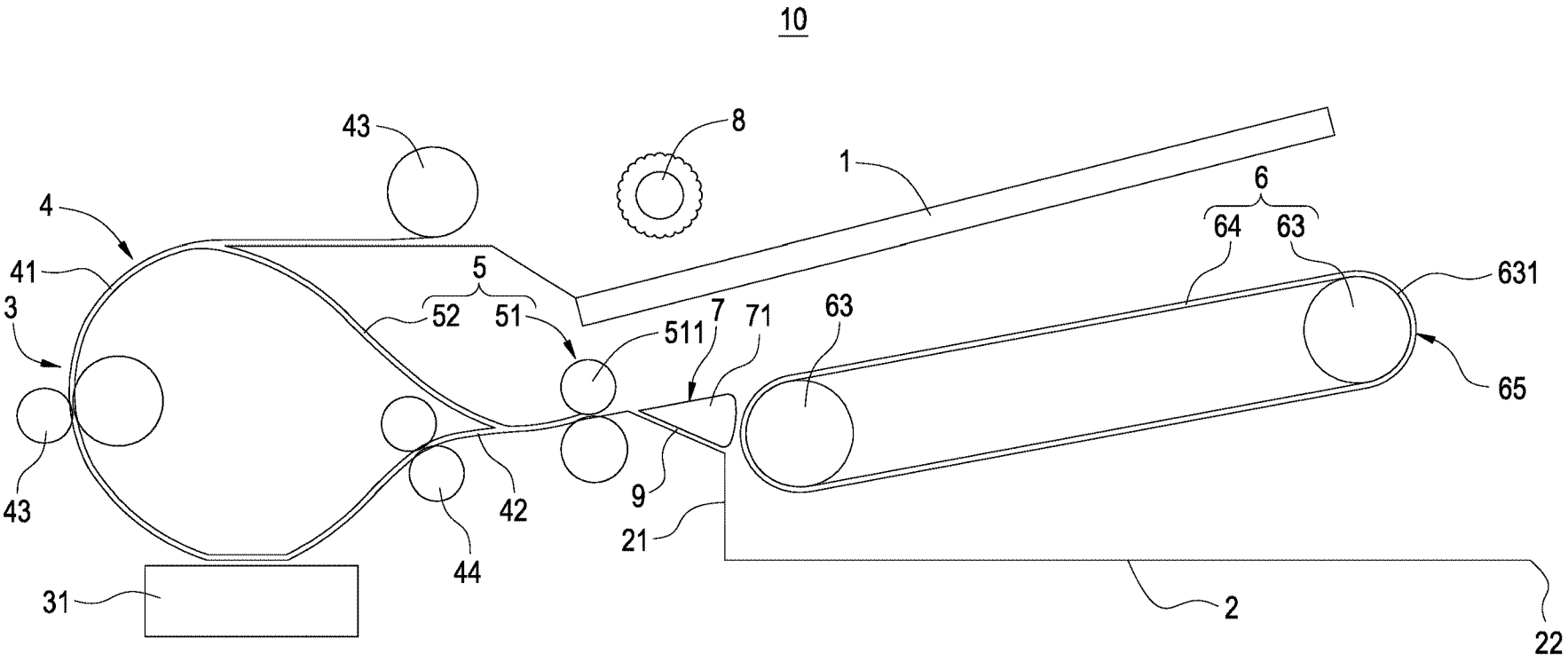
FIG. 7 is a perspective view showing an automatic sheet feeding device according to further another embodiment of this disclosure.

Referring to FIG. 7 showing another embodiment according to the automatic sheet feeding device 10 of this disclosure, the embodiment shown in FIG. 7 is substantially the same as the embodiment shown in FIGS. 1 to 5, and the embodiment shown in FIG. 7 has a flipping mechanism 6 different from the embodiment shown in FIGS. 1 to 5.

Further explanation is described below, the flipping mechanism 6 according to this embodiment has one or multiple negative pressure rollers 63 and a breathable belt 64. The breathable belt 64 sheathes and rotates with the negative pressure rollers 63, the sheet conveying portion 65 is constituted by a curved external surface 631 and a part of the breathable belt 64 wrapping the curved external surface 631. The curved external surface 631 is arranged on the one or multiple negative pressure rollers 63 adjacent to the second side 22 and rotates along the direction from the second side 22 toward the first side 21. The negative pressure roller 63 provides a negative pressure to the breathable belt 64, so that the sheet is driven by the breathable belt 64 to overturn firstly when passing through the curved external surface 631 and then conveyed to the sheet outputting tray 2 along the direction from the second side 22 toward the first side 21.

In addition, the switching guide mechanism 7 may be the swing block 71 for closing the sheet outputting channel 9 or blocking between the delivery channel 42 and the breathable belt 64. The swing block 71 may avoid the sheet from being conveyed to the breathable belt 64 when blocking between the delivery channel 42 and the breathable belt 64, so that the switching guide mechanism 7 may guide the sheet to be conveyed to the sheet outputting tray 2 from the sheet outputting channel 9 or to the sheet outputting tray 2 from the flipping mechanism 6. Therefore, the same functions and effects as the embodiments shown in FIGS. 1 to 5 may be achieved.

While this disclosure has been described by means of specific embodiments, numerous modifications and variations could be made thereto by those skilled in the art without departing from the scope and spirit of this disclosure set forth in the claims.

What is claimed is:

1. An automatic sheet feeding device used for a sheet, comprising:

a sheet outputting tray;

a sheet feeding tray;

a sheet outputting channel, disposed corresponding to the sheet outputting tray;

a flipping mechanism, arranged between the sheet outputting channel and the sheet outputting tray;

a sheet delivery area, disposed between the sheet feeding tray and the sheet outputting tray, the sheet delivery area comprising a scanning module and a first feeding mechanism, the first feeding mechanism comprising a flipping channel and a delivery channel, the flipping channel disposed between the sheet feeding tray and the scanning module, the delivery channel passing through the scanning module and disposed corresponding to the flipping mechanism, and one end of the delivery channel communicating with the flipping channel and another end of the delivery channel communicating with the sheet outputting channel; and a switching guide mechanism, arranged between the sheet outputting channel and the flipping mechanism, and configured to guide the sheet to be conveyed to the sheet outputting tray from the sheet outputting channel or conveyed to the sheet outputting tray from the flipping mechanism;

wherein the sheet outputting tray comprises a first side and a second side opposite to each other, the sheet outputting channel is disposed adjacent to the first side of the sheet outputting tray and configured to convey the sheet along a direction from the first side toward the second side, the flipping mechanism comprises a sheet conveying portion disposed adjacent to the second side of the sheet outputting tray and configured to convey the sheet along a direction from the second side toward the first side;

wherein the sheet delivery area further comprises a second feeding mechanism, the second feeding mechanism comprises a reversing component disposed corresponding to the delivery channel and a retrieving channel communicating with the flipping channel and the delivery channel, the reversing component comprises a reversing roller located on the delivery channel.

2. The automatic sheet feeding device according to claim 1, wherein the sheet outputting channel is disposed adjacent to a terminal end of the sheet outputting tray and extended along the direction from the first side toward the second side.

3. The automatic sheet feeding device according to claim 1, wherein the flipping mechanism comprises a reversing channel, one end of the reversing channel communicates with the delivery channel and a curved guiding channel is disposed on another end of the reversing channel, the sheet conveying portion is disposed on a terminal end of the curved guiding channel and extended along the direction from the second side toward the first side, the switching guide mechanism comprises a swing block configured to close the sheet outputting channel or the reversing channel.

4. The automatic sheet feeding device according to claim 3, wherein the flipping mechanism comprises at least one conveying roller located on the reversing channel.

5. The automatic sheet feeding device according to claim 1, wherein the flipping mechanism comprises at least one negative pressure roller and a breathable belt adapted to sheathe and rotating with the at least one negative pressure roller, the sheet conveying portion comprises a curved external surface and a part of the breathable belt wrapping the curved external surface, the curved external surface is arranged on the at least one negative pressure roller adjacent to the second side and rotating along the direction from the second side toward the first side, the switching guide mechanism comprises a swing block configured to close the sheet outputting channel or block between the delivery channel and the breathable belt.

6. The automatic sheet feeding device according to claim 1, further comprising a picking roller located at one end of the sheet feeding tray adjacent to the first feeding mechanism.

7. The automatic sheet feeding device according to claim 1, wherein the first feeding mechanism further comprises at least one first delivery roller located on the flipping channel and at least one second delivery roller located on the delivery channel.

* * * * *